US006474965B2

(12) United States Patent
Eiermann

(10) Patent No.: US 6,474,965 B2
(45) Date of Patent: Nov. 5, 2002

(54) ROTARY PISTON ENGINE HAVING A COGWHEEL PUMP AND AN OIL METERING PUMP

(75) Inventor: Dankwart Eiermann, Weissenberg (DE)

(73) Assignee: Brandenburgische Forschungs-und Entwicklungsgesellschaft Cottbus mbH, Cottbus (DE)

( * ) Notice: Subject to any disclaimer, the term of this patent is extended or adjusted under 35 U.S.C. 154(b) by 0 days.

(21) Appl. No.: 09/866,467

(22) Filed: May 29, 2001

(65) Prior Publication Data

US 2002/0015651 A1 Feb. 7, 2002

(30) Foreign Application Priority Data

May 27, 2000 (DE) ..... 100 26 447

(51) Int. Cl.[7] ..... F01C 21/04
(52) U.S. Cl. ..... 418/88; 418/61.2

(58) Field of Search ..... 418/61.2, 88

(56) References Cited

U.S. PATENT DOCUMENTS 4,657,009 A * 4/1987 Zen ..... 418/61.1
4,729,726 A * 3/1988 Kurio et al. ..... 418/61.2
5,100,309 A * 3/1992 Eiermann et al. ..... 418/88

FOREIGN PATENT DOCUMENTS

DE 2514733 * 11/1975 ..... 418/88

* cited by examiner

*Primary Examiner*—John J. Vrablik
(74) *Attorney, Agent, or Firm*—Crowell & Moring LLP

(57) ABSTRACT

A trochoidal design rotary piston engine design has an external axis cogwheel oil pump which has a smaller diameter drive cogwheel which drives a larger diameter size cogwheel where the larger diameter size cogwheel is coupled to an oil-metering pump. The larger cogwheel is supported in a side disk disposed at one side of an engine housing forming a combustion engine.

21 Claims, 3 Drawing Sheets

ROTARY PISTON ENGINE HAVING A COGWHEEL PUMP AND AN OIL METERING PUMP

BACKGROUND OF THE INVENTION

This application claims the priority of German application 100 26 447.6, filed May 27, 2000, the disclosure of which is expressly incorporated by reference herein.

This invention refers to a trochoidal design rotary piston engine with a rotary housing, two side disks, one with a bearing supported eccentric shaft and a rotary piston.

Such rotary piston engine, for example, is also known from the German Patent Document DE-C 40 03 663 (corresponding U.S. Pat. No. 5,199,863). In this type of a rotary piston engine, the supply of lubricant, cooling oil, and metered oil occurs by way of an additional set of devices propelled by the drive system of the rotary piston engine.

An object of the invention is to accomplish the task of providing the engine with an efficient supply of lubricant, cooling oil, and metered oil in a simplified manner.

This object has been achieved according to preferred embodiments of the invention in that the eccentric shaft in the area of one of the side disks is equipped with a cogwheel which forms a cogwheel pump with one of the side disk bearing supported cogwheels for pressure oil supply from which the drive of the oil metering pump is derived.

This type of construction provides a basis for a very compact drive, including a pump.

According to a further advantageous design development of the preferred embodiment of the invention, it is expected that the side disk mounted cogwheel will have a greater diameter, preferably at least twice the diameter, than the eccentric shaft cogwheel that would be connected to the oil-metering pump. That would also achieve that the oil-metering pump would be driven at a relatively lower rate of revolutions as it is found to be desirable in practice.

Other objects, advantages and novel features of the present invention will become apparent from the following detailed description of the invention when considered in conjunction with the accompanying drawings.

DETAILED DESCRIPTION OF THE PREFERRED EMBODIMENT

Figure 1:
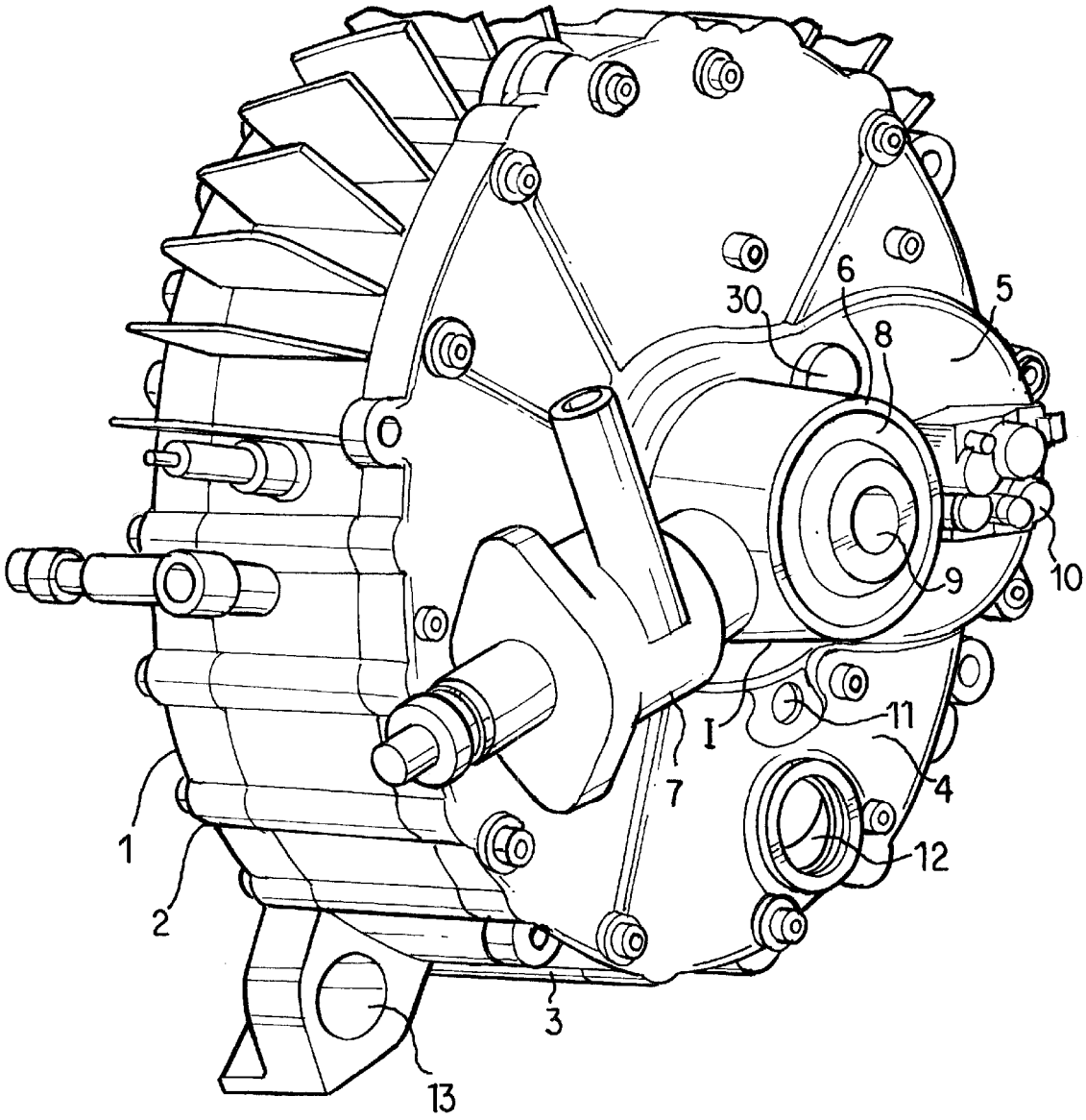
FIG. 1 shows a perspective view of a rotary piston engine, constructed according to a preferred embodiment of the invention.
Figure 2:
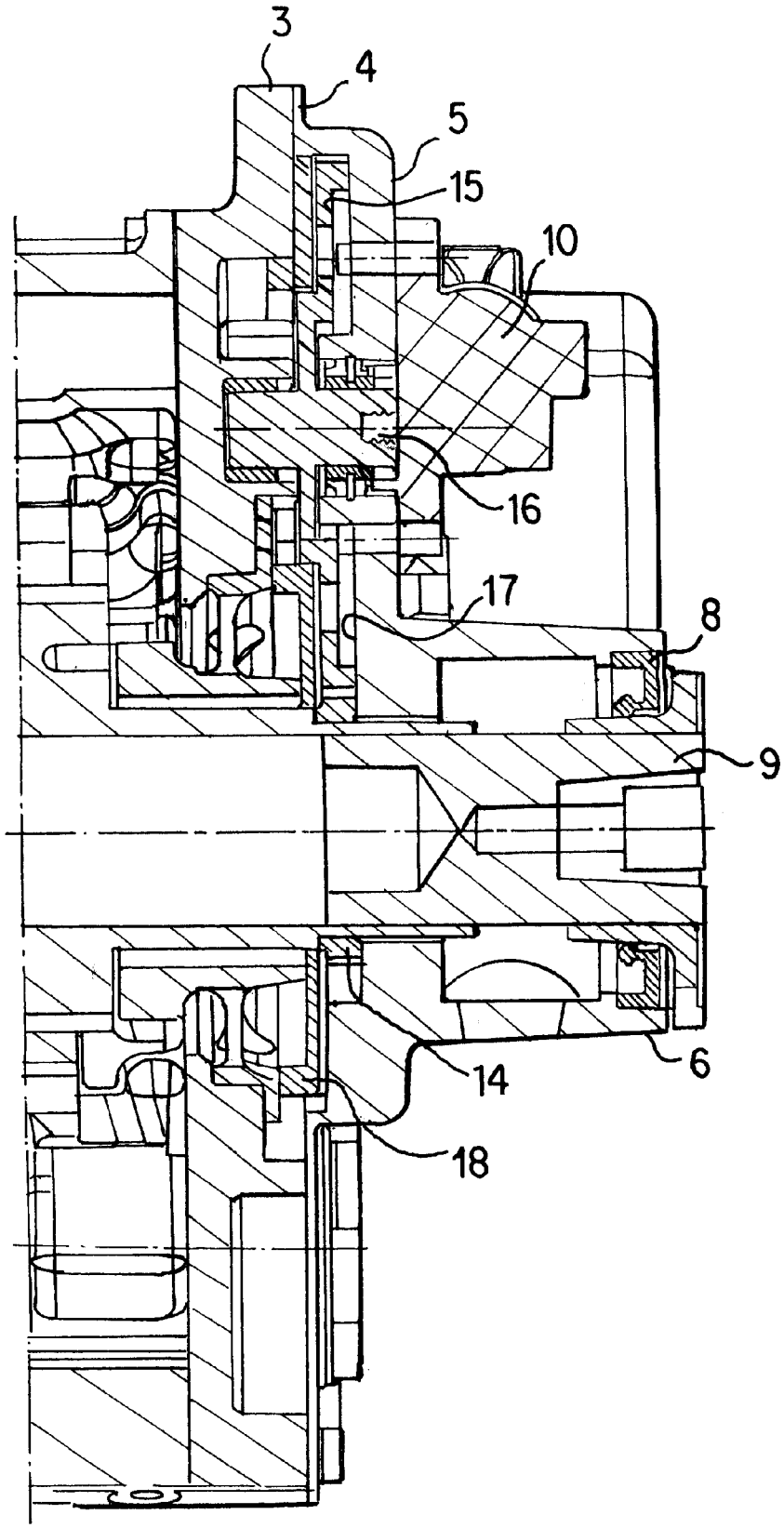
FIG. 2 shows a partial radial section of the rotary piston engine of FIG. 1 in an area of a pump drive.
Figure 3:
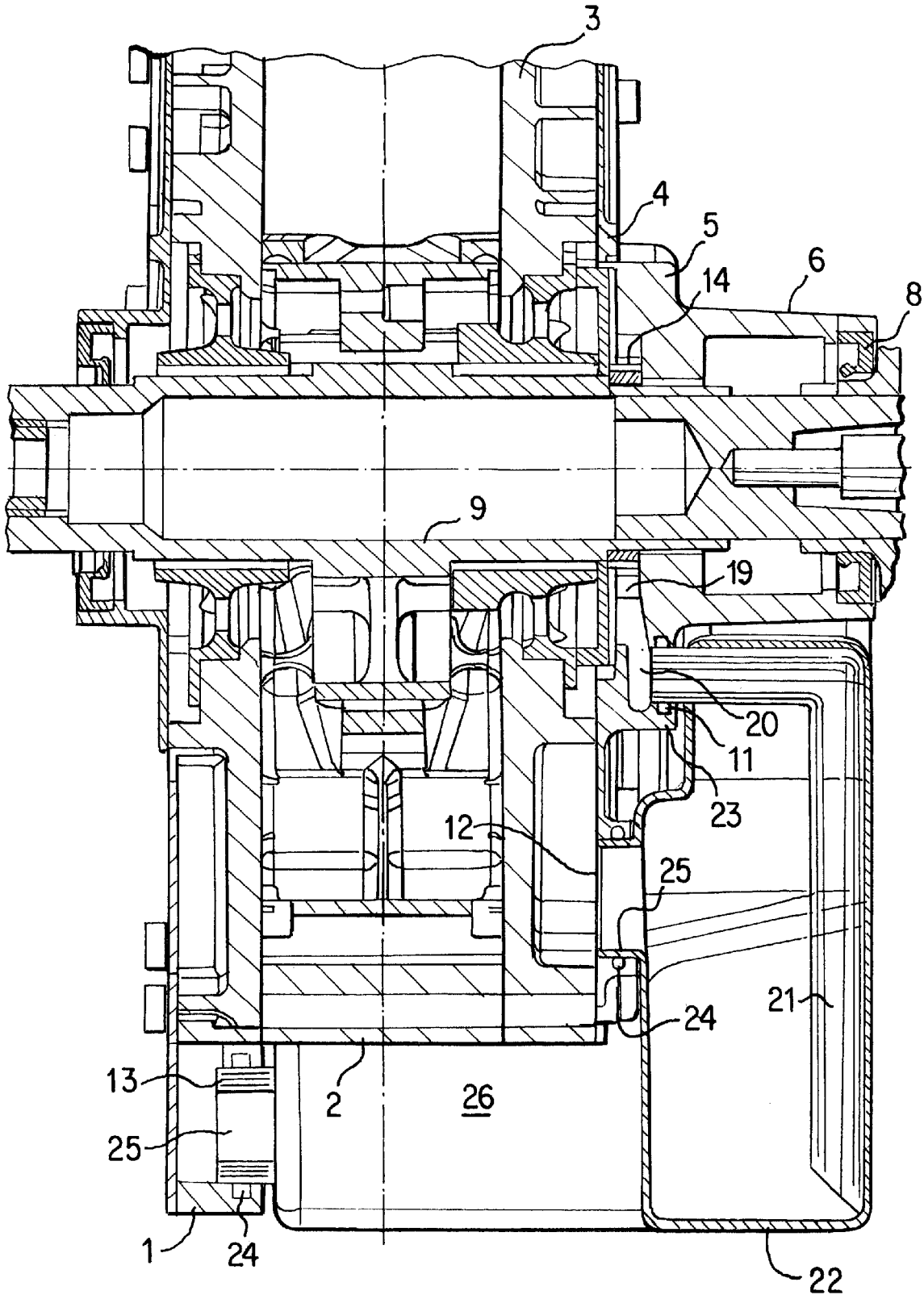
FIG. 3 shows a partial radial section of the rotary piston engine at another level with the rotary piston engine oil reservoir.

The rotary piston engine represented in FIGS. 1 through 3 is also a subject of parallel patent applications, filed in Germany May 27, 2000 with respective application numbers 100 26 448.4 and 100 26 449.2. The contents of corresponding U.S. application Ser. No. 09/866,466 and 09/866,484, filed May 29,2001 are incorporated herein by reference thereto to aid in an understanding of the present invention.

The rotary piston engine represented in FIGS. 1 through 3 has a left side disk 1, a rotary piston housing 2, and a right side disk 3. Each side disk consists of a cast part; one forming a radial wall enclosing the engine combustion chamber, and one of these radial walls exhibits a deflected shape external side covered by the side disk cover. The side disk cover 4 of the right side disk 3 is equipped with an extension with a cogwheel pump housing 5, a cylindrical housing 6 with an injection pump 7, and a shaft seal ring 8 for the eccentric shaft 9. Located on the cogwheel pump housing 5 is an oil-metering pump 10 that drips lubricating oil into the internal tracks of the rotary piston housing 2 and the side disks 1 and 3.

The cogwheel pump housing 5 is equipped with a supply line 11 in which the oil to be pumped is primed. Additionally, the cogwheel pump housing 5 has an outlet opening 30 to which the oil is delivered. The oil circulating in cycle with an oil cooler and an oil filter, and possibly also in a low pressure cooling cycle flows from the rotary piston engine through a drainage opening 12 of the side disk cover 4 of the right side disk 3 and a drainage opening 13 of the left side disk into an oil reservoir 22 (FIG. 3).

The supply line 11, as well as the drainage openings 12 and 13 are equi-directionally arranged, in the same direction, in the execution example in the axial direction, so that the oil reservoir 22, with its type of nozzle connections can be inserted into these openings. At the same time, a nozzle type connection is formed for the supply opening 11 from the priming intake pipe (21), which is installed in the oil reservoir 22 and is extended down to its bottom. The nozzle type connections, that is the intake pipe 21, which leads to the supply channel 20 of the intake chamber 19 of the cogwheel pump and both nozzles 25 are sealed with seal rings 23 and 24.

The cogwheel oil pump comprises a drive cogwheel 14, which is installed on the eccentric shaft 9. This drive cogwheel 14 meshes with a driven cogwheel 15 (FIG. 2) which is located in the side disk 3 and the pump housing 5 serving side disk cover 4. Cogwheel pump housing 5 has passages (not shown) connecting the cogwheel oil pump to the supply line 11 and the outlet opening 30. This driven cogwheel 15 has a significantly larger diameter, that is, a diameter that is at least twice the diameter of the drive cogwheel 14. The driven cogwheel 15 of the cogwheel pump is connected to an oil-metering pump shaft of the oil-metering pump 10 by a slotted tongue and groove link 16. The drive cogwheel 14 and the driven cogwheel 15 in the axial direction are sealed on the one side by the interior surface of the cogwheel disk cover 4 and on the other side by the plane surface of an inset plate 18.

According to another preferred embodiment of the invention, three cogwheels are used, including the drive wheel 14, an intermediate wheel, and then the driven wheel 15. This will make it possible, should that be desired, to implement a separation of the two oil cycles; for example, a low pressure cooling cycle and the pressure oil lubrication cycle. The drive cogwheel 14 could also diverge from the represented design and be developed by cutting gears on the eccentric shaft 9.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A rotary piston engine comprising:

a housing;

first and second side disks at respective opposite sides of the housing to form a rotary piston chamber;

an eccentric shaft for a rotary piston extending in said housing;

a cogwheel pump including a first cogwheel mounted on the eccentric shaft, and a second cogwheel mounted on the first side disk to be drivingly engageable with said first cogwheel; and an oil metering pump operable to supply lubricating oil to tracks of the housing and side disks, wherein the oil metering pump is driven by the second cogwheel of the cogwheel pump.

2. A rotary piston engine according to claim 1, wherein the second cogwheel has a larger diameter than the first cogwheel.

3. A rotary piston engine according to claim 2, wherein the second cogwheel has a diameter at least twice as large as the diameter of the first cogwheel.

4. A rotary piston engine according to claim 3, wherein the second cogwheel has an axle connected to the oil metering pump by a slotted tongue and groove connection.

5. A rotary piston engine according to claim 1, wherein both the first and second cogwheels are installed between an inset plate facing the first side disk and a side disk cover with an integrated cogwheel pump housing.

6. A rotary piston engine according to claim 5, wherein an oil reservoir for lubricating oil is provided which has an receptacle attached respectively to oil drainage openings of both side disks and to a primary chamber of the cogwheel pump housing.

7. A rotary piston engine according to claim 6, wherein the oil drainage openings of the side disks and a junction opening of the primary chamber are equi-directionally arranged.

8. A rotary piston engine according to claim 6, comprising a primary pipe in the reservoir which leads to a junction opening of the primary chamber.

9. A rotary piston engine comprising:

a housing, first and second side disks at respective opposite sides of the housing to form a rotary piston chamber, an eccentric shaft for a rotary piston extending in said housing, an oil metering pump operable to supply lubricating oil to tracks of the housing and side disks, a first cogwheel mounted on the eccentric shaft and disposed adjacent the first side disk, and a second cogwheel mounted on the first side disk to be drivingly engageable with said first cogwheel to drive the oil metering pump, wherein the second cogwheel has a diameter at least twice as large as the diameter of the first cogwheel.

10. A rotary piston engine according to claim 9, wherein the second cogwheel has an axle connected to the oil metering pump by a slotted tongue and groove connection.

11. A rotary piston engine according to claim 10, wherein both the first and second cogwheel are installed between an inset plate facing the first side disk and a side disk cover with an integrated cogwheel pump housing.

12. A rotary piston engine according to claim 11, wherein an oil reservoir for lubricating oil is provided which has a receptacle attached respectively to oil drainage openings of both side disks and to a primary chamber of the cogwheel pump housing.

13. A rotary piston engine according to claim 9, wherein both the first and second cogwheel are installed between an inset plate facing the first side disk and a side disk cover with an integrated cogwheel pump housing.

14. A rotary piston engine according to claim 13, wherein an oil reservoir for lubricating oil is provided which has a receptacle attached respectively to oil drainage openings of both side disks and to a primary chamber of the cogwheel pump housing.

15. A rotary piston engine according to claim 14, comprising a primary pipe in the reservoir which leads to a junction opening of the primary chamber.

16. A rotary piston engine comprising:

a housing, first and second side disks at respective opposite sides of the housing to form a rotary piston chamber, an eccentric shaft for a rotary piston extending in said housing, an oil metering pump operable to supply lubricating oil to tracks of the housing and side disks, a first cogwheel mounted on the eccentric shaft and disposed adjacent the first side disk, and a second cogwheel mounted on the first side disk to be drivingly engageable with said first cogwheel to drive the oil metering pump, wherein both the first and second cogwheel are installed between an inset plate facing the first side disk and a side disk cover with an integrated cogwheel pump housing.

17. A rotary piston engine according to claim 16, wherein an oil reservoir for lubricating oil is provided which has an receptacle attached respectively to oil drainage openings of both side disks and to a primary chamber of the cogwheel pump housing.

18. A rotary piston engine according to claim 17, comprising a primary pipe in the reservoir which leads to a junction opening of the primary chamber.

19. A rotary piston engine according to claim 17, wherein the oil drainage openings of the side disks and a junction opening of the primary chamber are equi-directionally arranged.

20. A rotary piston engine according to claim 19, wherein the oil drainage openings of the side disks and a junction opening of the primary chamber are equi-directionally arranged.

21. An oil metering pump assembly for use with a rotary piston engine of the type having a piston housing covered at one end with a side disk which supports an eccentric shaft, said pump assembly comprising:

an oil metering pump housing cover connectible to a side disk of the engine, a first cogwheel mountable on the eccentric shaft and disposed adjacent the first side disk, and a second cogwheel mounted on the first side disk to be drivingly engageable with said first cogwheel to drive the oil metering pump, wherein the second cogwheel has a diameter at least twice as large as the diameter of the first cogwheel.

* * * * *